United States Patent [19]

Hupp et al.

[11] Patent Number: 4,457,092

[45] Date of Patent: Jul. 3, 1984

[54] BREECH MECHANISM FOR AUTOMATIC FIREARMS

[75] Inventors: Gerhard Hupp, Oberndorf; Helmut Mader, Schramberg, both of Fed. Rep. of Germany

[73] Assignee: Mauser-Werke Oberndorf GmbH, Oberndorf, Fed. Rep. of Germany

[21] Appl. No.: 320,834

[22] Filed: Nov. 12, 1981

[30] Foreign Application Priority Data

Nov. 26, 1980 [DE] Fed. Rep. of Germany ... 8031454[U]

[51] Int. Cl.[3] ..... F41C 15/00; F41C 11/00

[52] U.S. Cl. ..... 42/25; 42/16

[58] Field of Search ..... 42/16, 25

[56] References Cited

U.S. PATENT DOCUMENTS 476,290 6/1892 Mauser ..... 42/16

4,066,000 1/1978 Rostocil ..... 42/25

*Primary Examiner*—Charles T. Jordan

*Assistant Examiner*—Ted L. Parr

*Attorney, Agent, or Firm*—Scully, Scott, Murphy & Presser

[57] ABSTRACT

In automatic firearms having a caliber in the range of about 20 to 40 mm, so-called "jammed shell casings" are occasionally encountered due to the high cadences during the extraction and ejection of the empty cartridge casings, so that the returning breech mechanism tends to lose the cartridge, and the ejector plunger no longer fully impacts against the casing to be ejected. In order to avoid this drawback a recess arranged in the breech head concentrically to the firing pin is provided along its periphery opposite an extractor claw with at least one projection to assist in the centering and retention of the cartridge casing and which can be adapted to the respective type of breech mechanism. The projection is formed by cutting or non-cutting working. Preferably, two or more such projections are formed which then, together with the extractor claw, form a type of "three-point support" for the cartridge casing during the extraction.

6 Claims, 2 Drawing Figures

BREECH MECHANISM FOR AUTOMATIC FIREARMS

BACKGOUND OF THE INVENTION

1. Field of the Invention

The present invention relates to a breech mechanism for automatic firearms which includes a recess or the like being arranged in the breech head concentrically to the firing pin and serving to receive the impact base of a cartridge casing, as well as an extractor arranged movably within the breech head and extending axially-parallel to the firing pin, the claw of the extractor engaging in an annular slot of the cartridge casing so as to fix the cartridge casing in the recess.

2. Discussion of the Prior Art

Modern automatic weapons with calibers in the order of 20 to 40 mm, as a rule incorporate high rates of fire. These high firing rates are necessary in order to bring a large number of projectiles to the target within the shortest time, such as flying objects traveling in the sonic range or the like.

At these high rates of fire it is not possible to prevent so-call "jammed shell casings" from occurring during the extraction and ejection of the empty cartridge casings. The returning breech mechanism hereby will more or less lose the casing, and the ejector plunger will then no longer fully impact against the casing which is to be ejected. This failure caused by this phenomenon can have serious inherent disadvantages on the battle field, for the operation of the weapon, as well as for the respective tactical attack-or defense concept.

SUMMARY OF THE INVENTION

In view of these drawbacks and disadvantages which are attendant to a large number of breech systems, it is an object of the present invention to further develop the breech mechanisms, even of existing automatic firearms, through the utilization of the simplest means, in such a manner that the empty cartridge casing is held in the breech head in a precisely defined position so as to positively ensure its ejection from the weapon.

The foregoing object is achieved, according to the invention, in that the recess located in the breech head concentrically to the firing pin is provided along its periphery generally opposite the extractor claw with at least one projection, protuberance or the like which will assist in the centering and retention of the cartridge casing and which is adaptable to the respective type of breech mechanism, and which can be formed by either cutting and/or without cutting processes.

In a further development of the basic concept underlying the invention, the forming of the projection, protuberance or the like, is effected by drilling a blind hole into the end face of the breech head, and which is subsequently partly generally spherically widened, whereby the material displaced during the widening in the direction of the recess periphery forms the projection.

A modification of this type of formation for the projection according to another feature of the invention, consists in producing the projection, protuberance or the like by (profile) milling.

As can be ascertained from the foregoing, the projection can be formed on the breech heads in a relatively simple manner. This is naturally also possible to incorporate subsequently into weapons which are in use by the troops. The projections are formed in this case, as applicable, either during field- or depot repairs; forwarding the weapons which are to be re-equipped to the plant of the manufacturer for re-tooling is accordingly eliminated.

BRIEF DESCRIPTION OF THE DRAWINGS

Reference may now be had to a detailed description of the invention, taken in conjunction with the accompanying drawings; in which.

DETAILED DESCRIPTION

Figure 1:
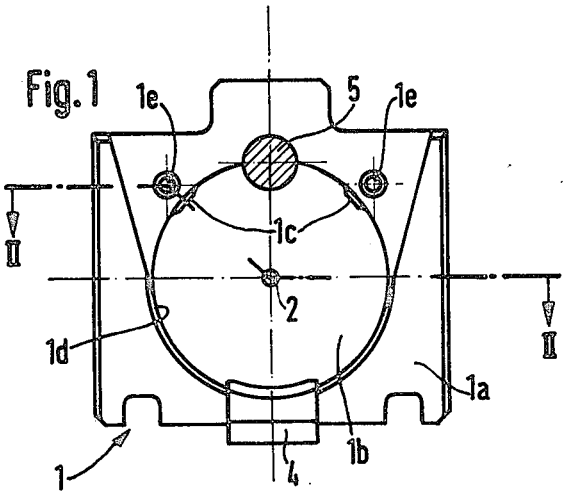
FIG. 1 shows a breech head in front view.

The breech head, generally designated with reference numeral 1, has on its end face 1*a* facing towards the weapon barrel (not shown) a rotationally symmetrical recess 1*b*, arranged concentrically relative to firing pin 2. The diameter and depth of the recess 1*b* are hereby so dimensioned that they are capable of receiving the rearward portion of cartridge casing 3 with its impact base 3*a* with relatively little play. Diametrically opposed to a claw 4 of the cartridge casing extractor (not shown) is an ejector plunger 5.

Cartridge casing 3 is held in the recess 1*b* primarily by the extractor claw 4, which engages the groove, annular slot 3*b* ahead of the impact base 3*a*. In addition, cartridge casing 3 is also centered and retained by projection or projections 1*c*. This ensures that cartridge casing 3 is located in a coaxial-centric position relative to firing pin 2 during the extracting and ejection sequence.

Figure 2:
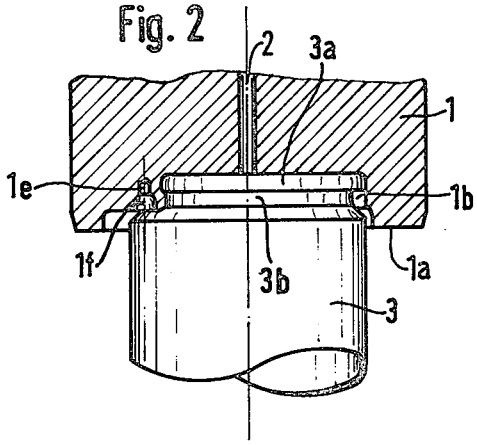
FIG. 2 shows a vertical section in the region of the cartridge casing support taken along line II–II in FIG. 1.

For the manufacture of the projection or protuberances 1*c*, a blind bore 1*e* is drilled at a predetermined distance from periphery 1*d* of recess 1*b*. This bore is thereafter partly widened substantially spherically 1*f* (FIG. 2); the material displaced during the widening in the direction of the recess periphery thus forms the projection 1*c*.

The formation of the projection 1*c* can also be effected by (profile) milling or the like. While the first mentioned type of production of the projectional 1*c* is more suitable for field or depot operations, the second-mentioned method can be applied preferably during the manufacture of the breech head 1.

We claim:

1. A breech mechanism for automatic weapons, said breech mechanism comprising:

(a) a breech head for an automatic weapon, said head having a recess in the breech head for receiving the impact base of a cartridge casing;

(b) a firing pin mounted for reciprocal movement in said breech head;

(c) an ejector means mounted for reciprocal movement in said breech head, the axis of reciprocation for said ejector means being parallel to the reciprocal movement of said firing pin, (d) first and second projections formed on the periphery of said recess in said breech head, said projections being formed along an arc concentric with said firing pin and separated from one another by an angle of at least 60 degrees, (e) an extractor claw for engaging a cartridge base and centering the cartridge base between the claw and the first and second projections;

whereby said projections and said claw cooperate both center and retain the cartridge prior to its ejection.

2. A breech mechanism for high speed automatic weapon as as claimed in claim 1 wherein said projections are arranged at an angle of about 90 degrees relative to each other.

3. A breech mechanism for high speed automatic weapons as claimed in claim 1 wherein said first and second projections define first and second radial protrusions for engaging a circumferential groove defined in said cartridge base.

4. A breech mechanism for high speed automatic weapons, said breech mechanism comprising:

(a) a breech head for an automatic weapon, said head having a recess in the breech head for receiving the impact base of a cartridge casing;

(b) a firing pin mounted for reciprocal movement in said breech head; (c) an ejector means mounted for reciprocal movement in said breech head, the axis of reciprocation for said ejector means being parallel to the reciprocal movement of said firing pin, (d) first and second projections formed on the periphery of said recess in said breech head, said projections being formed along an arc concentric with said firing pin and separated from one another by an angle of at least 60 degrees;

(e) an extractor claw mounted opposite said projections for radial movement with respect to said firing pin, said claw engaging a cartridge base and centering the cartridge base between the claw and the first and second projections;

whereby said projections and said claw cooperate both center and retain the cartridge prior to its ejection.

5. A breech mechanism for high speed automatic weapons as claimed in claim 4 wherein said projections are arranged at an angle of about 90 degrees relative to each other.

6. A breech mechanism for high speed automatic weapons as claimed in claim 4 wherein said first and second projections each define a radial protrusion for engaging a circumferential groove defined in said cartridge base.

* * * * *

UNITED STATES PATENT OFFICE

CERTIFICATE OF CORRECTION

Patent No. 4,457,092 Dated July 3, 1984

Inventor(s) Gerhard Hupp et al.

It is certified that error appears in the above-identified patent and that said Letters Patent are hereby corrected as shown below:

Column 3, line 4, delete the words "high speed".

Column 3, line 8, delete the words "high speed".

Column 3, line 13, delete the words "high speed".

Column 4, line 14, delete the words "high speed".

Column 4, line 18, delete the words "high speed".

Signed and Sealed this

*Twentieth* Day of *November 1984*

[SEAL]

*Attest:*

GERALD J. MOSSINGHOFF

*Attesting Officer*

*Commissioner of Patents and Trademarks*